US011081845B2

(12) United States Patent
Sun et al.

(10) Patent No.: US 11,081,845 B2
(45) Date of Patent: Aug. 3, 2021

(54) VACUUM PUMP, AND CONNECTOR AND CONTROL DEVICE APPLIED TO VACUUM PUMP

(71) Applicant: Edwards Japan Limited, Chiba (JP)

(72) Inventors: Yanbin Sun, Chiba (JP); Kengo Saegusa, Chiba (JP); Yoshiyuki Sakaguchi, Chiba (JP); Hideki Omori, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 16/469,794

(22) PCT Filed: Dec. 8, 2017

(86) PCT No.: PCT/JP2017/044246
§ 371 (c)(1),
(2) Date: Jun. 14, 2019

(87) PCT Pub. No.: WO2018/123522
PCT Pub. Date: Jul. 5, 2018

(65) Prior Publication Data

US 2020/0099179 A1 Mar. 26, 2020

(30) Foreign Application Priority Data

Dec. 28, 2016 (JP) ..... JP2016-256649

(51) Int. Cl.
*H01R 13/73* (2006.01)
*F04D 29/40* (2006.01)
(Continued)

(52) U.S. Cl.
CPC ..... *H01R 13/73* (2013.01); *F04D 29/40* (2013.01); *H01R 12/75* (2013.01); *H01R 13/04* (2013.01)

(58) Field of Classification Search
CPC ..... F04D 19/042; F04D 29/403; F04D 29/40; H01R 13/73; H01R 13/04; H01R 12/75
(Continued)

(56) References Cited

U.S. PATENT DOCUMENTS 4,906,211 A * 3/1990 Bell ..... H01R 13/187 439/843
5,499,935 A * 3/1996 Powell ..... H01R 13/66 439/182
(Continued)

FOREIGN PATENT DOCUMENTS

EP 3029327 A1 6/2016
EP 3088737 A1 11/2016
(Continued)

OTHER PUBLICATIONS

PCT International Search Report dated Feb. 20, 2018 for corresponding PCT Application No. PCT/JP2017/044246.
(Continued)

*Primary Examiner* — Gary F Paumen
(74) *Attorney, Agent, or Firm* — Theodore M. Magee; Westman, Champlin & Koehler, P.A.

(57) ABSTRACT

A vacuum pump has a hermetic connector disposed on a base of a body of the vacuum pump. The hermetic connector has a plurality of pins connected to a plurality of electrical cables leading to the inside of the pump body. The connector is longer in a lateral direction than in an axial direction so that the connector is horizontally long in a circumferential direction of the pump body.

7 Claims, 7 Drawing Sheets

(51) Int. Cl.
*H01R 12/75* (2011.01)
*H01R 13/04* (2006.01)

(58) Field of Classification Search
USPC ..... 439/682–691, 76.1, 577
See application file for complete search history.

(56) References Cited

U.S. PATENT DOCUMENTS 9,743,507 B2 * 8/2017 Tago ..... H01L 23/12
2002/0039533 A1 * 4/2002 Miyamoto ..... F04D 29/584 417/313
2006/0281352 A1 * 12/2006 Kabasawa ..... H01R 13/631 439/247
2010/0303650 A1 * 12/2010 Englaender ..... F04D 17/168 417/422
2013/0189089 A1 * 7/2013 Schroder ..... F04D 19/042 415/182.1
2013/0189090 A1 * 7/2013 Okudera ..... F04D 19/042 415/182.1
2016/0195098 A1 * 7/2016 Omori ..... F04D 19/042 417/423.7
2019/0242387 A1 * 8/2019 Saegusa ..... H01R 13/52

FOREIGN PATENT DOCUMENTS

JP H10507806 A 7/1998
JP H11173293 A 6/1999
JP 2002021851 A 1/2002
JP 2003018797 A 1/2003
JP 2006250033 A 9/2006
JP 2011228639 A 11/2011
WO 2007022657 A1 3/2007
WO 2015029536 A1 3/2015

OTHER PUBLICATIONS

PCT International Written Opinion dated Feb. 20, 2018 for corresponding PCT Application No. PCT/JP2017/044246.
Communication dated Jul. 10, 2020 for corresponding European application Serial No. 17888020.9.

* cited by examiner

VACUUM PUMP, AND CONNECTOR AND CONTROL DEVICE APPLIED TO VACUUM PUMP

CROSS-REFERENCE OF RELATED APPLICATION

This application is a Section 371 National Stage Application of International Application No. PCT/JP2017/044246, filed Dec. 8, 2017, which is incorporated by reference in its entirety and published as WO 2018/123522 A1 on Jul. 5, 2018 and which claims priority of Japanese Application No. 2016-256649, filed Dec. 28, 2016.

BACKGROUND

The present invention relates to a vacuum pump, and a connector and a control device applied to the vacuum pump. More particularly, the present invention relates to a vacuum pump that is designed in a way that improves the efficiency of on-site maintenance, can be configured into a smaller pump than before, and can easily be manufactured, and a connector and a control device applied to such a vacuum pump.

With the recent development of electronics, the demand for semiconductors such as memories and integrated circuits has been increasing rapidly.

These semiconductors are manufactured by doping impurities into an extremely pure semiconductor substrate to give electrical properties or by forming a fine circuit on the semiconductor substrate by means of etching.

These operations need to be performed in a high vacuum chamber in order to avoid the impact of dust and the like in the air. Typically a vacuum pump is used for exhausting such a chamber, and particularly a turbomolecular pump, a type of vacuum pump, is frequently used from the viewpoint of low residual gas, easy maintenance, and the like.

A semiconductor manufacturing process includes a large of number of processes in which various process gases are caused to act on the semiconductor substrate, and the turbomolecular pump is used not only to evacuate the chamber but also to exhaust these process gasses from the chamber.

Such a turbomolecular pump is composed of a pump body and a control device for controlling the pump body.

The pump body and the control device are usually connected by a cable and a connector plug mechanism. There has been known a structure such as the one described in Japanese Patent Application Laid-open No. H11-173293 which enables attachment/detachment of the pump body and the control device in an axial direction of the pump in order to avoid wrong connection of the cable between the pump body and the control device and the hassle of adjusting the length of the cable.

The discussion above is merely provided for general background information and is not intended to be used as an aid in determining the scope of the claimed subject matter. The claimed subject matter is not limited to implementations that solve any or all disadvantages noted in the background.

SUMMARY

Incidentally, the available space around the pump body and the control device integrated with each other as described above is typically small. In particular, there is usually not enough space in the axial direction. Therefore, when performing maintenance, the pump body and the control device integrated with each other need to be removed from the chamber and then, while integrated with each other, need to be moved to a place where ample workspace can be obtained.

Also, when terminals are disposed in a bottom portion of the pump body in the axial direction, a worker needs to check the attachment/detachment of the terminals while peeking through the small gap between the pump body and the control device in order to align the positions of the terminals on the pump body side and the terminals on the control device side, which is not easy and makes the maintenance difficult.

Moreover, since there is not enough space in the axial direction as described above, it is desirable to make the pump body short in the axial direction and even smaller in a radial direction.

It is also desirable to make manufacturing of the pump body easy while making the pump body smaller than before.

The present invention was contrived in view of these problems related to the prior art, and an object of the present invention is to provide a vacuum pump that not only is designed to improve the efficiency of on-site maintenance but also can be made smaller than before and manufactured easily, and a connector and a control device applied to the vacuum pump.

Thus, the present invention (claim 1) is a vacuum pump, having a connector that is disposed in a side portion of a base portion of a pump body and has a plurality of pins connected to a plurality of electrical cables leading to the inside of the pump body, wherein the connector is longer in a lateral direction than in an axial direction so that the connector is horizontally long in a circumferential direction of the pump body.

Since the connector is disposed in the side portion of the base portion, the pump body and a control device can easily be attached to and detached from each other without ample space in the axial direction of the pump. The connector is configured to be longer in the lateral direction than in the axial direction so that the connector is horizontally long in the circumferential direction of the pump body. Therefore, since the cables connected to the connector can be distributed in the circumferential direction of the pump body, and as a result the height of the pump body can be reduced.

The present invention (claim 2) is a vacuum pump in which the plurality of pins of the connector are arranged in such a manner that the number of rows of pins in the circumferential direction of the pump body is greater than the number of rows of pins in the axial direction.

The present invention (claim 3) is a vacuum pump in which, of the plurality of pins, large-diameter pins are disposed at a central part of the connector, and small-diameter pins are disposed around the large-diameter pins.

The thick pins with large allowable current are disposed on the inside and the pins with small allowable current are disposed around the thick pins. Since hard, inflexible, thick cables to be connected to the thick pins are grouped together in the center, the cables can be twisted easily when bundled. The connectors are bundled and then twisted to reduce the lengths of the cables, so that the connectors can be stored in a hole or the like neatly and easily.

The present invention (claim 4) is a vacuum pump in which, of the plurality of electrical cables, large-diameter electrical cables are connected to end portions of the large-diameter pins on the inside of the pump body.

The present invention (claim 5) is a vacuum pump, having a control device for controlling the pump body attachably and detachably with respect to the base portion, wherein a substrate for electrical connection is fixed to atmosphere-side end portions of the plurality of pins, the substrate being provided with a terminal and the substrate being electrically connected to the control device via a second electrical cable connected to the terminal.

Connecting the pins and the terminal using the substrate prevents the cables from becoming bulky in a radial direction of the pump body, unlike when the cables are pulled with harnesses as in the prior art. Accordingly, the pump body can be reduced in size in the radial direction as well.

The present invention (claim 6) is a vacuum pump in which the plurality of pins and the terminal in the substrate are electrically connected by a wiring pattern having a multilayer structure.

By forming the multilayered wiring pattern on the substrate in a thickness direction, even when a large number of pins are present, the intervals between the pins can be reduced.

The present invention (claim 7) is a connector which is installed in the vacuum pump described in any of claims 1 to 6.

The present invention (claim 8) is a control device which is applied to the vacuum pump described in any of claims 1 to 6 and configured to be attachable and detachable by moving in the radial direction with respect to the pump body.

Since the control device is configured to be movable in the radial direction, maintenance can easily be carried out even in a place where ample workspace cannot be obtained in the axial direction of the pump.

According to the present invention (claim 1), as described above, the connector is provided in the side portion of the base portion of the pump body and made longer in the lateral direction than in the axial direction so that the connector is horizontally long in the circumferential direction of the pump body. Therefore, the pump body and the control device can easily be attached to and detached from each other even when there is not enough space in the axial direction of the pump. In addition, since the cables connected to the connector can be distributed in the circumferential direction of the pump body, the height of the pump body can be reduced.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

Figure 1:
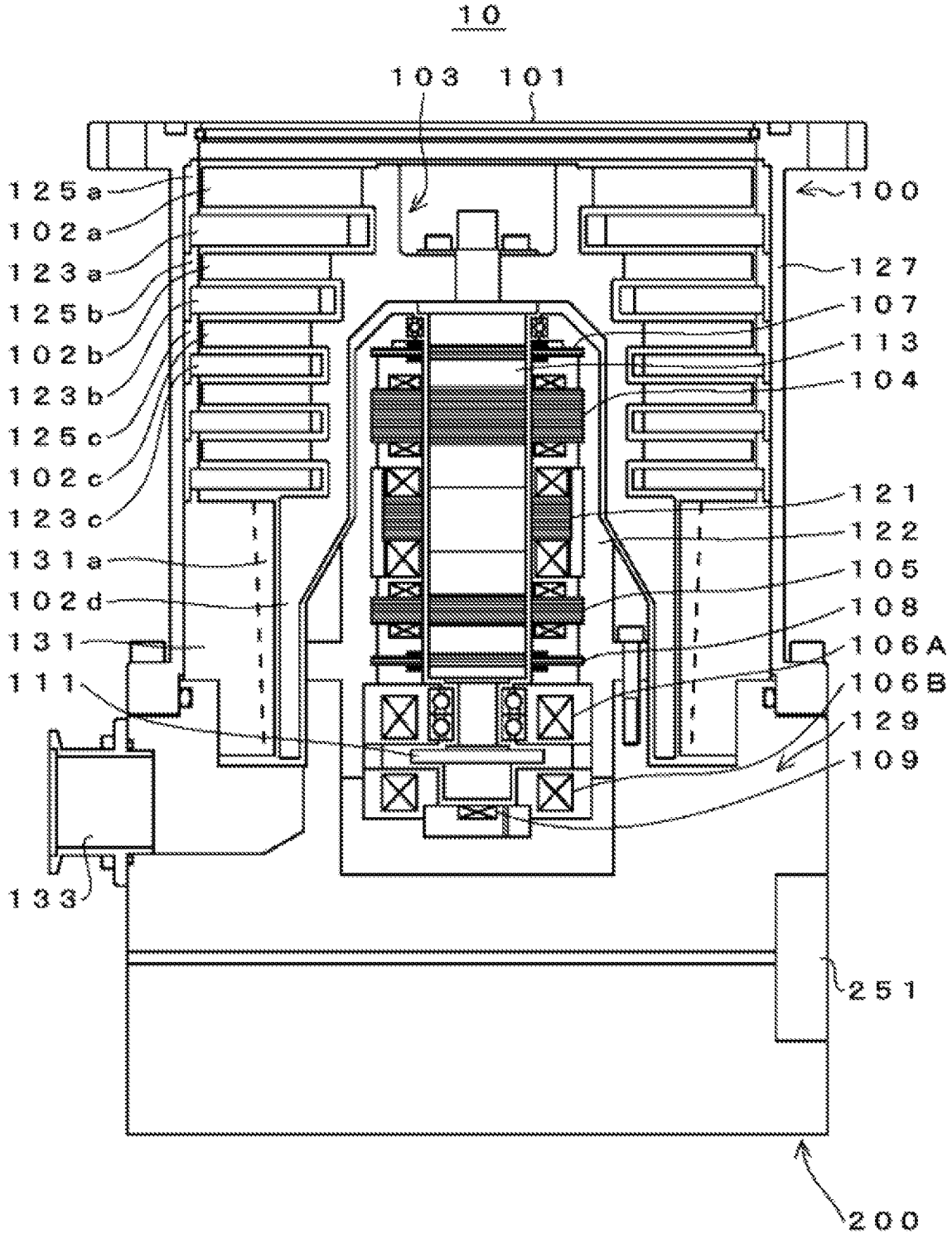
FIG. 1 is an overall configuration diagram of an embodiment of the present invention.

An embodiment of the present invention is now described hereinafter. FIG. 1 shows a configuration diagram of the embodiment of the present invention. As shown in FIG. 1, a turbomolecular pump 10 has a pump body 100 and a control device 200 integrated with each other.

An inlet port 101 is formed at an upper end of a cylindrical outer cylinder 127 of the pump body 100. A rotating body 103 in which a plurality of rotor blades 102*a*, 102*b*, 102*c*, etc., are formed radially in multiple stages on a peripheral portion is provided inside the outer cylinder 127, the rotor blades being configured as turbine blades for sucking and exhausting a gas.

A rotor shaft 113 is attached to the center of the rotating body 103. The rotor shaft 113 is supported afloat and has the position thereof controlled in the air by a so-called 5-axis control magnetic bearing.

An upper radial electromagnet 104 has four electromagnets arranged in pairs along an X-axis and a Y-axis that are radial coordinate axes of the rotor shaft 113 and are perpendicular to each other. An upper radial sensor 107 composed of four electromagnets is provided in the vicinity of and corresponding to the upper radial electromagnet 104. The upper radial sensor 107 is configured to detect a radial displacement of the rotating body 103 and send the radial displacement to the control device 200.

On the basis of a displacement signal detected by the upper radial sensor 107, the control device 200 controls the excitation of the upper radial electromagnet 104 via a compensation circuit having a PID adjustment function, and adjusts an upper radial position of the rotor shaft 113.

The rotor shaft 113 is made of a high magnetic permeability material (such as iron) and configured to be attracted by the magnetic force of the upper radial electromagnet 104. Such adjustment is performed in the X-axis direction and the Y-axis direction independently.

A lower radial electromagnet 105 and a lower radial sensor 108 are disposed in the same manner as the upper radial electromagnet 104 and the upper radial sensor 107, and a lower radial position of the rotor shaft 113 is adjusted in the same manner as the upper radial position of the rotor shaft 113.

Furthermore, axial electromagnets 106A and 106B are arranged so as to vertically sandwich a disc-shaped metal disc 111 provided under the rotor shaft 113. The metal disc 111 is made of a high magnetic permeability material such as iron. An axial sensor 109 is configured to detect an axial displacement of the rotor shaft 113 and send an axial displacement signal thereof to the control device 200.

Based on the axial displacement signal, the excitation of the axial electromagnets 106A and 106B is controlled via the compensation circuit of the control device 200 that has the PID adjustment function. The axial electromagnet 106A and the axial electromagnet 106B use the magnetic forces thereof to attract the metal disc 111 upward and downward respectively.

In this manner, the control device 200 is configured to appropriately adjust the magnetic forces of the axial electromagnets 106A and 106B acting on the metal disc 111 and to cause the rotor shaft 113 to magnetically float in the axial direction and keep the rotor shaft 113 in the air in a non-contact manner.

The motor 121 has a plurality of magnetic poles circumferentially arranged to surround the rotor shaft 113. Each of the magnetic poles is controlled by the control device 200 to drive the rotor shaft 113 to rotate by means of an electromagnetic force acting between each magnetic pole and the rotor shaft 113.

A plurality of stator blades 123*a*, 123*b*, 123*c*, etc., are arranged with a small gap from the rotor blades 102*a*, 102*b*,

102*c*, etc. The rotor blades 102*a*, 102*b*, 102*c*, etc., are inclined at a predetermined angle from a plane perpendicular to the axis of the rotor shaft 113, in order to transfer molecules of exhaust gas downward by collision.

Similarly, the stator blades 123 are inclined at a predetermined angle from the plane perpendicular to the axis of the rotor shaft 113, and are arranged alternately with the stages of the rotor blades 102 in such a manner as to face inward of the outer cylinder 127.

Ends of the respective rotor blades 123 are fitted between and supported by a plurality of stacked stator blade spacers 125*a*, 125*b*, 125*c*, etc.

The stator blade spacers 125 are each a ring-like member and made of a metal such as aluminum, iron, stainless steel, copper, or an alloy containing these metals as components.

The outer cylinder 127 is fixed to an outer periphery of the stator blade spacers 125 with a small gap therefrom. A base portion 129 is disposed at a bottom portion of the outer cylinder 127, and a threaded spacer 131 is disposed between the bottom end of the stator blade spacer 125 and the base portion 129. An outlet port 133 is formed under the threaded spacer 131 in the base portion 129 and communicated with the outside.

The threaded spacer 131 is a cylindrical member made of a metal such as aluminum, copper, stainless steel, iron, or an alloy containing these metals as components, and a plurality of thread grooves 131*a* are engraved in a spiral manner in an inner peripheral surface of the threaded spacer 131.

The direction of the spiral of the threaded grooves 131*a* is a direction in which the molecules of the exhaust gas are transferred toward the outlet port 133 when the molecules of the exhaust gas move in a direction of rotation of the rotating body 103.

A rotor blade 102*d* hangs down at the lowermost portion following the rotor blades 102*a*, 102*b*, 102*c*, etc., of the rotating body 103. An outer peripheral surface of the rotor blade 102*d* is in a cylindrical shape, protrudes toward the inner peripheral surface of the threaded spacer 131, and is positioned in the vicinity of the inner peripheral surface of the threaded spacer 131 with a predetermined gap therefrom.

The base portion 129 is a disk-like member constituting a base of the turbomolecular pump 10 and typically made of a metal such as iron, aluminum, or stainless steel.

Since the base portion 129 physically holds the turbomolecular pump 10 and functions as a heat conducting path, it is desirable that a metal with rigidity and high thermal conductivity such as iron, aluminum, or copper be used as the base portion 129.

According to this configuration, when the rotor blades 102 are driven by the motor 121 and rotate together with the rotor shaft 113, the exhaust gas from a chamber is sucked in through the inlet port 101 by the actions of the rotor blades 102 and the stator blades 123.

The exhaust gas sucked in through the inlet port 101 passes between the rotor blades 102 and the stator blades 123 and is transferred to the base portion 129. At this moment, the temperature of the rotor blades 102 rises due to the frictional heat caused when the exhaust gas contacts or collides with the rotor blades 102 or the conduction or radiation of the heat generated by the motor 121. Such heat is transmitted toward the stator blades 123 by radiation or by conduction by gas molecules of the exhaust gas.

The stator blade spacers 125 are joined to each other by outer peripheral portions thereof, and transmit the heat received by the stator blades 123 from the rotor blades 102 and the frictional heat caused when the exhaust gas contacts or collides with the stator blades 123, to the outer cylinder 127 and the threaded spacer 131.

The exhaust gas transferred to the threaded spacer 131 is sent to the outlet port 133 while being guided by the thread grooves 131*a*.

Next is described a structure around terminals for connecting control cables or power cables between the pump body 100 and the control device 200.

Figure 2:
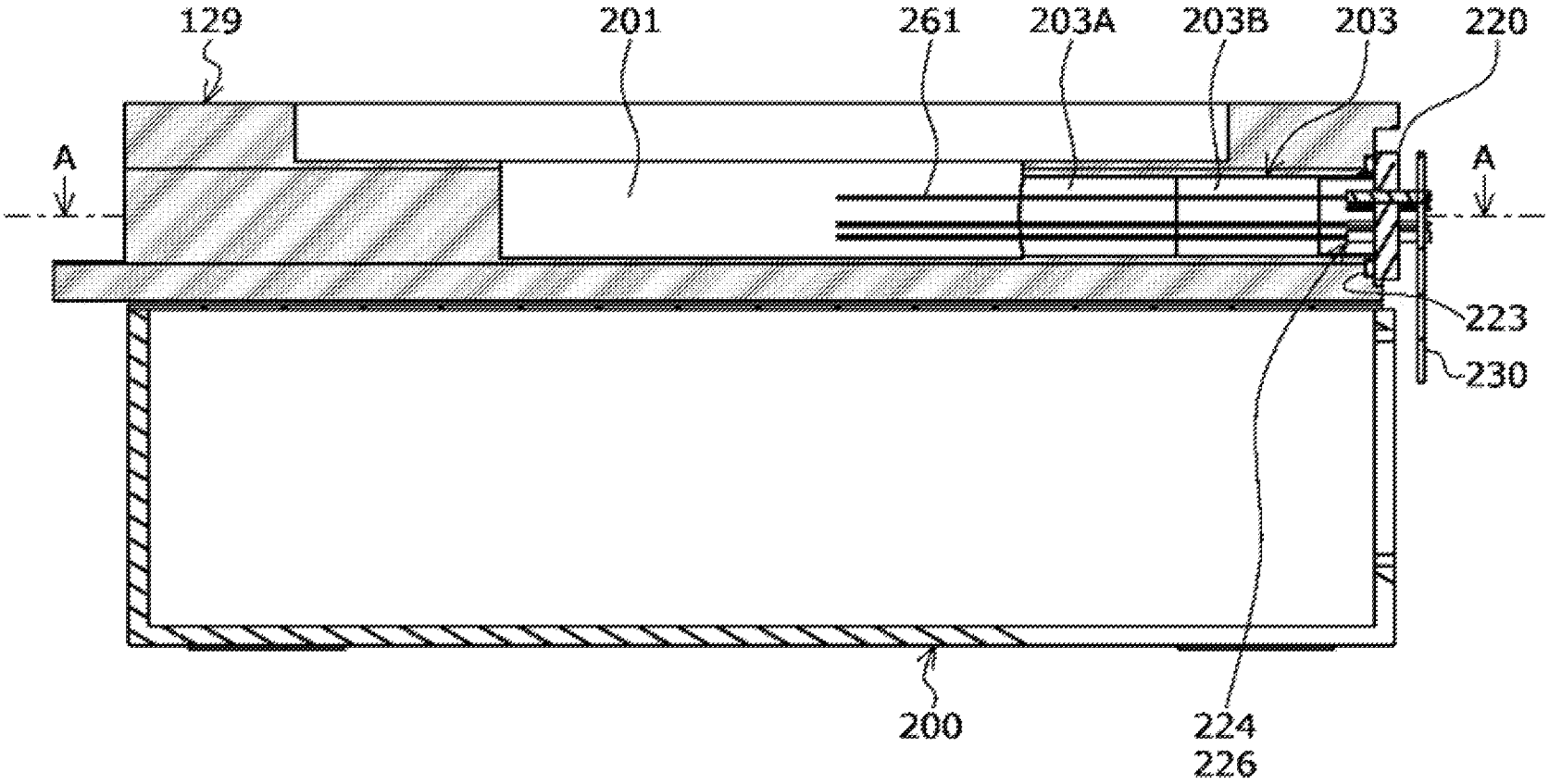
FIG. 2 is a longitudinal cross-sectional view showing a base portion and the periphery of a control device.
Figure 3:
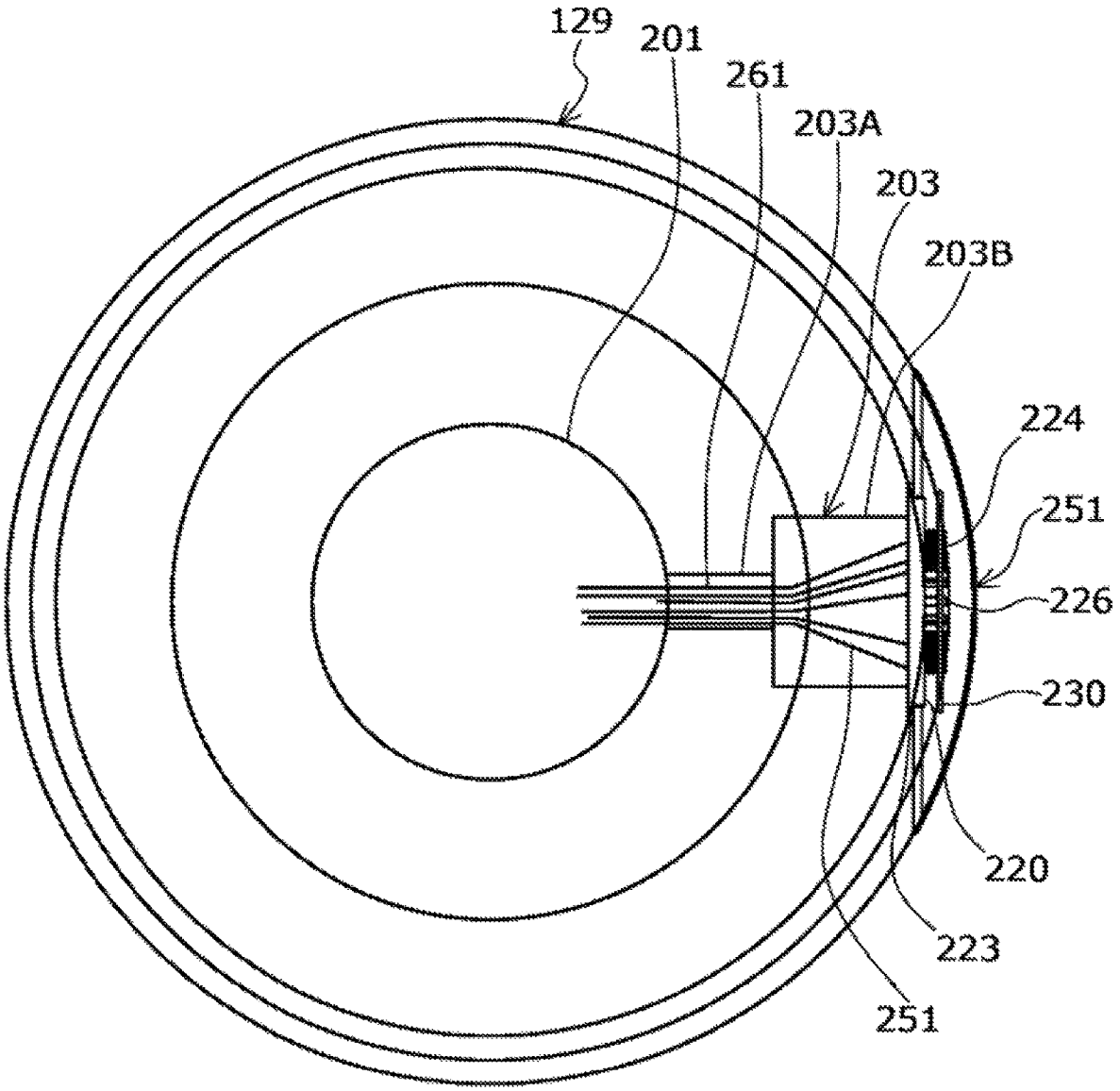
FIG. 3 is a cross-sectional view taken along arrow A-A of FIG. 2.

FIG. 2 is a cross-sectional view showing the base portion and the periphery of control device. FIG. 3 shows a cross-sectional view taken along arrow A-A of FIG. 2. As shown in FIGS. 2 and 3, a cylindrical bottom space 201 is formed in the center of the base portion 129. A communication hole 203 extending from the bottom space 201 and communicated with a side portion of the base portion 129 is formed at one place.

Figure 4:
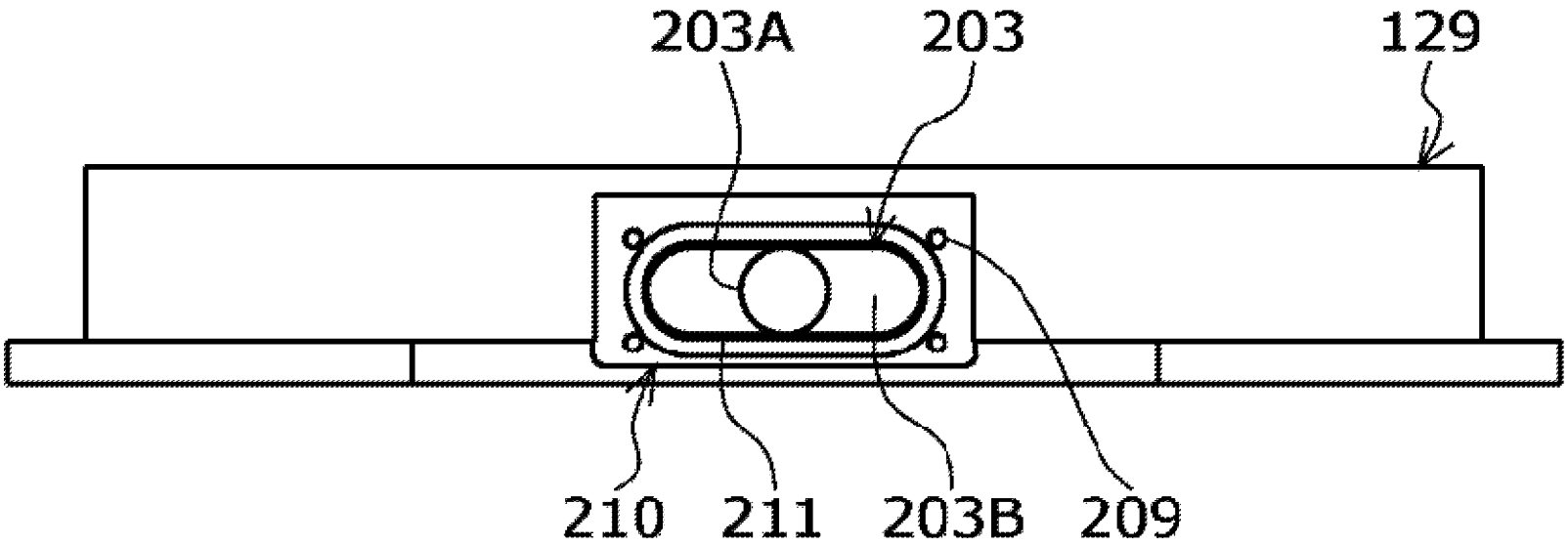
FIG. 4 is a front view showing the base portion with respect to a receiving portion.

The communication hole 203 has a circular hole 203A at the bottom space 201 side and is narrow. An outer peripheral side of the communication hole 203 that continues to the circular hole 203A configures a horizontally long hole 203B. The horizontally long hole 203B is in a rectangular shape having semicircular shapes on either side. FIG. 4 is a front view showing the base portion from the outside with respect to a receiving portion. In FIG. 4, the circular hole 203A is seen behind the horizontally long hole 203B.

As shown in FIG. 3, the communication hole 203 is connected in such a manner that the circular hole 203A and the horizontally long hole 203B together form a step in the middle when each having a constant cross section in the radial direction. However, the communication hole 203 may be formed in such a manner that the cross section thereof gradually becomes narrow from the horizontally long hole 203B toward the circular hole 203A. A receiving portion 210 having bolt holes 209 therearound is formed in an outer end portion of the communication hole 203 so that a hermetic connector 220 having a horizontally long structure shown in FIG. 5 can be attached to the receiving portion 210.

The hermetic connector 220 has a horizontally long structure in which a horizontal length thereof is preferably 1.5 times or more, or more preferably 2 times or more, of a vertical length 1. A rectangular recess 211 having semicircular shapes on either side is engraved around the communication hole 203 of the receiving portion 210.

Figure 5:
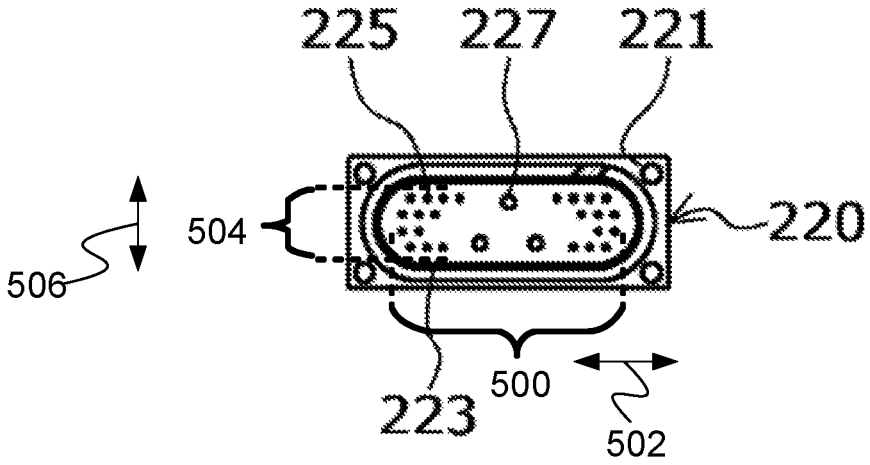
FIG. 5 is a rear view of a hermetic connector having a horizontally long structure.

FIG. 5 shows a rear surface of the hermetic connector 220. Bolt holes 221 are formed in the four corners of the hermetic connector 220. A rectangular O-ring 223 having semicircular shapes on either side, which is embedded in the recess 211 of the receiving portion 210, is provided on the inside of the bolt holes 221. On the inside of the O-ring 223, a plurality of small-diameter holes 225 through which small-diameter pins 224 are passed are arranged on either side of three large-diameter holes 227 through which large-diameter pins 226 are passed.

Figure 6:
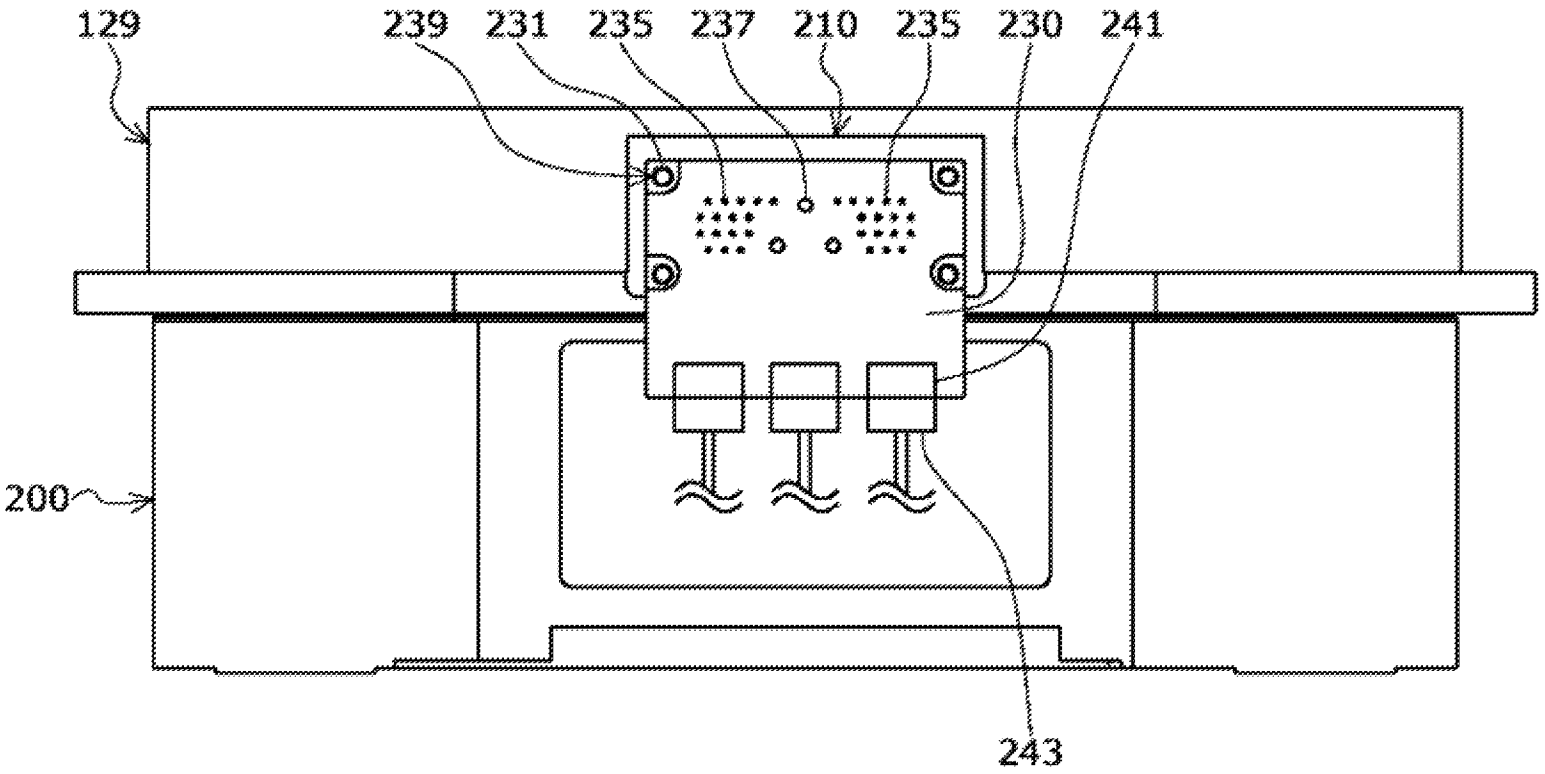
FIG. 6 is a diagram showing a substrate from the outside of the base portion.

As shown in FIGS. 2 and 5, tips of the small-diameter pins 224 passing through the small-diameter holes 225 of the hermetic connector 220 and tips of the large-diameter pins 226 passing through the large-diameter holes 227 are inserted into small-diameter holes 235 and large-diameter holes 237 of a substrate 230 shown in FIGS. 3 and 6. The inside of each of the small-diameter holes 225 of the hermetic connector 220 and the inside of each of the large-diameter holes 237 are vacuum-sealed. FIG. 6 shows the substrate 230 from the outside of the base portion 129. As shown in FIG. 6, bolt holes 231 are formed in the four corners of the substrate 230.

As is clear from FIG. 5, the pins of the hermetic connector 220 are arranged in such a manner that the number of rows 500 of pins in the circumferential direction 502 of the pump body 100 is greater than the number of rows 504 of pins in the axial direction 506.

The hermetic connector 220 and the substrate 230 are screwed to the receiving portion 210 with bolts 239 through the bolt holes 209, the bolt holes 221, and the bolt holes 231. Although not shown, a multilayered wiring pattern is formed in the substrate 230 in a thickness direction thereof, and terminals 241 are arranged at a lower end of the substrate 230. One end of the wiring pattern is electrically connected to each of the small-diameter pins 224 and large-diameter pins 226, whereas the other end is connected to each terminal 241.

Cables are drawn from the terminals 241 into the control device 200 by harnesses 243 corresponding to second electrical cables.

Functions of the embodiment of the present invention are described next.

Circular hermetic connectors have conventionally been used. However, a circular hermetic connector makes a bundle of cables bulky, inevitably increasing the height of the pump body 100 in the axial direction. Since the embodiment of the present invention adopts the hermetic connector 220 having a horizontally long structure in which the pins are arranged in such a manner that the number of rows of pins in the circumferential direction of the pump body is greater than the number of rows of pins in the axial direction, the cables can be distributed in the horizontal direction, thereby reducing the height of the pump body 100 in the axial direction.

Furthermore, using the substrate 230, the small-diameter pins 224 and the large-diameter pins 226 are connected to the terminals 241 by the multilayered wiring pattern formed inside the substrate. Thus, unlike when the cables are pulled with the harnesses as in the prior art, the cables do not become bulky in the radial direction of the pump body 100. As a result, the pump body 100 can be reduced in size in the radial direction as well.

In FIG. 2, right ends of cables 261 corresponding to electrical cables are soldered to left ends of the small-diameter pins 224 and left ends of the large-diameter pins 226. To facilitate this soldering, the hermetic connector 220 is pulled out to the outside of the base portion 129 by approximately 5 to 10 cm. After completion of the soldering, the hermetic connector 220 needs to be pushed into the receiving portion 210 and brought into abutment with the receiving portion 210.

In the past, however, due to a large number of cables 261 and because thick power cables with large allowable current and thin, control or signal cables with small allowable current were mixed together in a circular hermetic connector, the cables were hard and inflexible. Consequently, bundling and storing the cables in the communication hole 203 was a difficult task.

Therefore, according to the present embodiment, as shown FIGS. 5 and 6, in the hermetic connector 220 and the substrate 230, the thick pins with large allowable current are arranged inside and the pins with small allowable current are arranged around the thick pins. This is because the thick cables are harder and more inflexible than the thin cables.

Since the hard, inflexible cables are grouped together in the center, the cables can be twisted easily when bundled. Consequently, the lengths of the cables can be shortened by bundling and twisting the hermetic connector 220 approximately 540 degrees and then stored easily in the communication hole 203.

By forming the multilayered wiring pattern in the substrate 230 in the thickness direction, the distance between the pins can be reduced in spite of the large number of pins.

Next, in the present embodiment, the hermetic connector 220 is disposed beside the base portion 129 as described above, thereby enabling easy maintenance. The circumstances involved in maintenance are now described hereinafter on the basis of a procedure for performing maintenance shown in FIGS. 7A to 7D.

Figure 7:
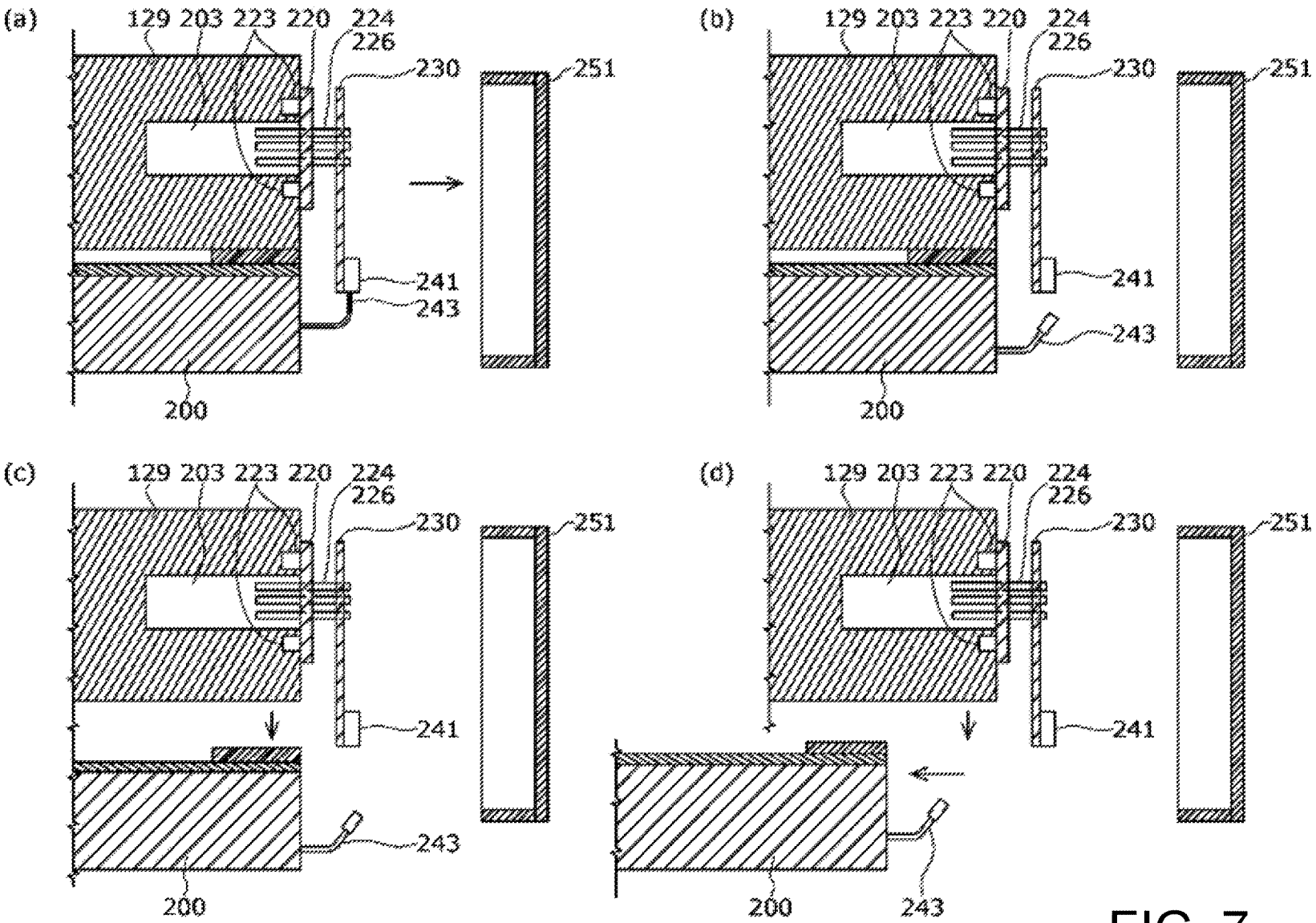
FIGS. 7A to 7D are diagrams showing a procedure for performing maintenance.

First, as shown in FIG. 7A, when performing maintenance, a wall cover 251 is removed from the side portions of the base portion 129 and the control device 200. In FIG. 7B, the harnesses 243 are removed from the terminals 241. Next, in FIG. 7C, the bolts, not shown, which fasten the base portion 129 and the control device 200, are removed, and a housing of the control device 200 is lowered by approximately several tens of millimeters. Next, as shown in FIG. 7D, the housing of the control device 200 is pulled out in the radial direction of the pump.

In this manner, the pump body 100 and the control device 200 can easily be attached to and detached from each other even when there is not enough space in the axial direction of the vacuum pump. Even in a state in which the pump body 100 is attached to the chamber not shown, maintenance can easily be performed on the control device 200. Since the terminals are arranged on the side portion of the vacuum pump, the terminals can easily be seen by removing the wall cover 251, enabling easy attachment/detachment of the harnesses 243 to/from the terminals 241.

Note that the embodiment of the present invention and each modification hereof may be combined as needed. Various modifications can be made to the present invention without departing from the spirit of the present invention, and it goes without saying that the present invention extends to such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a connector that is disposed on a side portion of a base portion of a pump body and has a plurality of pins connected to a plurality of electrical cables leading to the inside of the pump body, wherein a surface of the connector through which the plurality of pins extend in a radial direction is longer in a lateral direction than in an axial direction of the pump body, and wherein the lateral direction and the radial direction are perpendicular to the axial direction, a substrate for electrical connection is fixed to atmosphere-side end portions of the plurality of pins, and the substrate is formed by a wiring pattern having a multilayer structure in a thickness direction.

2. The vacuum pump according to claim 1, wherein the plurality of pins of the connector are arranged in such a manner that the number of rows of pins in the lateral direction of the pump body is greater than the number of rows of pins in the axial direction.

3. The vacuum pump according to claim 1, wherein, of the plurality of pins, large-diameter pins are disposed at a central part of the connector, and small-diameter pins are disposed around the large-diameter pins.

4. The vacuum pump according to claim 3, wherein, of the plurality of electrical cables, large-diameter electrical cables are connected to end portions of the large-diameter pins on the inside of the pump body.

5. The vacuum pump according to claim 1, comprising a control device for controlling the pump body attachably and detachably with respect to the base portion, wherein the substrate being provided with a terminal and the substrate being electrically connected to the control device via a second electrical cable connected to the terminal.

6. A connector which is installed in the vacuum pump described in claim 1.

7. A control device which is applied to the vacuum pump described claim 1 and configured to be attachable and detachable by moving in the radial direction with respect to the pump body.

* * * * *